US008657633B2

(12) United States Patent
Shindo et al.

(10) Patent No.: US 8,657,633 B2
(45) Date of Patent: Feb. 25, 2014

(54) CONNECTOR

(75) Inventors: Jun Shindo, Tokyo (JP); Masaki Kimura, Tokyo (JP); Kazuaki Ibaraki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/456,553

(22) Filed: Apr. 26, 2012

(65) Prior Publication Data

US 2012/0276784 A1 Nov. 1, 2012

(30) Foreign Application Priority Data

Apr. 28, 2011 (JP) ..... 2011-101549

(51) Int. Cl.
*H01R 24/66* (2011.01)

(52) U.S. Cl.
USPC ..... 439/660; 439/736; 439/924.1

(58) Field of Classification Search
USPC ..... 439/660, 722, 736, 924.1
See application file for complete search history.

(56) References Cited

U.S. PATENT DOCUMENTS 6,004,160 A * 12/1999 Korsunsky et al. ..... 439/660
6,083,051 A * 7/2000 Chang ..... 439/660
7,112,087 B2 9/2006 Tago et al.
7,189,105 B2 3/2007 Takaku et al.
7,273,390 B2 * 9/2007 Iida et al. ..... 439/494
7,794,271 B2 * 9/2010 Wu et al. ..... 439/497
8,419,474 B2 * 4/2013 Zhang et al. ..... 439/607.25
2011/0070779 A1 * 3/2011 Zhang et al. ..... 439/660
2012/0276784 A1 * 11/2012 Shindo et al. ..... 439/660

FOREIGN PATENT DOCUMENTS

JP 2004-362827 A 12/2004
JP 10-2006-0070450 A 6/2006
JP 2010-62072 A 3/2010

OTHER PUBLICATIONS

Korean Office Action dated Mar. 27, 2013 (and English translation thereof) in counterpart Korean Application No. 10-2012-0030924.

* cited by examiner

*Primary Examiner* — James Harvey
(74) *Attorney, Agent, or Firm* — Holtz, Holtz, Goodman & Chick

(57) ABSTRACT

A connector according to the present invention comprises a housing and a plurality of contacts. The housing includes a mating portion having a plate shape. The mating portion projects forward and has an upper surface and a bottom surface. The plurality of contacts is held by the housing. Each of the contacts comprises a contact portion, an end portion and a flat portion. The contact portion extends in a connection direction and is exposed at the upper surface of the mating portion. The end portion is embedded in the mating portion. The flat portion forms a boundary between the contact portion and the end portion and does not projects from the upper surface. The flat portion is able to be viewed from above the upper surface of the mating portion.

13 Claims, 10 Drawing Sheets

CONNECTOR

CROSS REFERENCE TO RELATED APPLICATION

Applicant claims priority under 35 U.S.C. §119 of Japanese Patent Application No. JP 2011-101549 filed Apr. 28, 2011.

BACKGROUND OF THE INVENTION

The present invention relates to a connector which comprises a mating portion having a plate shape.

Connectors of the above-mentioned type are disclosed in JP-A 2010-62072 and JP-A 2004-362827, each of which is incorporated herein by reference in its entirety. The connector disclosed in JP-A 2010-62072 comprises a mating portion 130' which has an asymmetrical shape in a thickness direction (see FIG. 17 of the present application). Because of the asymmetrical shape, contacts of a mating connector (not shown) can be guided appropriately so that the mating connector is smoothly connected with the connector. The connector disclosed in JP-A 2004-362827 comprises another type of mating portion 130" which has a top surface and a bottom surface and a plurality of contacts 150". Each of the contacts 150" has a principal contact section 154" and an end portion 156". The end portion 156" is exposed at the top surface while the contact section 154" is positioned on the bottom surface. When a housing of the connector is molded, a molding-die is inserted between the neighboring contacts 150" so that the contacts 150" are arranged appropriately in a pitch direction (see FIGS. 18A to 18C (especially FIG. 18C) of the present application).

However, the connectors disclosed in JP-A 2010-62072 and JP-A 2004-362827 have following problems. In detail, when the housing is molded, resin may be pushed aside by a molding-die and the pushed resin may cover an end part of contact portion. The resin on the contact portion may come off and interrupt an electrical connection between the contact and a mating contact.

SUMMARY OF THE INVENTION

It is therefore an object of the present invention to provide a connector which has a new structure solving the above-mentioned problem.

One aspect of the present invention provides a connector comprising a housing and a plurality of contacts. The housing includes a mating portion having a plate-like shape. The mating portion projects forward and has an upper surface and a bottom surface. The plurality of contacts is held by the housing. Each of the contacts comprises a contact portion, an end portion, and a flat portion. The contact portion extends in a mating direction and is exposed at the upper surface of the mating portion. The end portion is embedded in the mating portion. The flat portion forms a boundary between the contact portion and the end portion and does not project from the upper surface. The flat portion is able to be viewed from above the upper surface of the mating portion.

An appreciation of the objectives of the present invention and a more complete understanding of its structure may be had by studying the following description of the preferred embodiment and by referring to the accompanying drawings.

Figure 1:
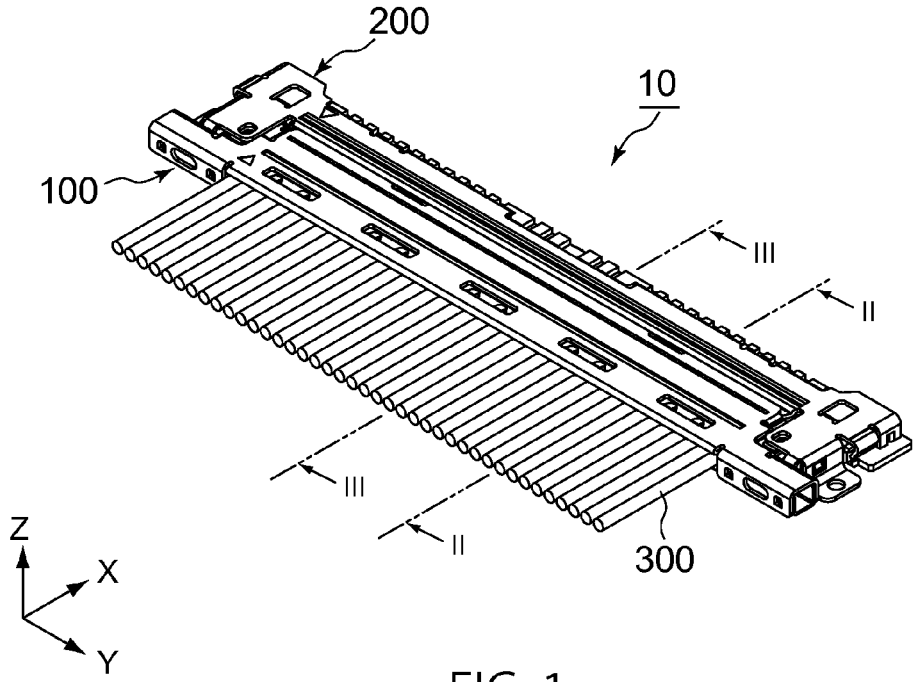
FIG. 1 is an oblique view showing a connector assembly according to an embodiment of the present invention. A connector (a plug connector) is connected with a mating connector (a receptacle connector).

While the invention is susceptible to various alternative embodiments and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all alternative embodiments, equivalents and alternatives falling within the spirit and scope of the present invention as defined by the appended claims.

DESCRIPTION OF THE PREFERRED EMBODIMENTS

Figure 2:
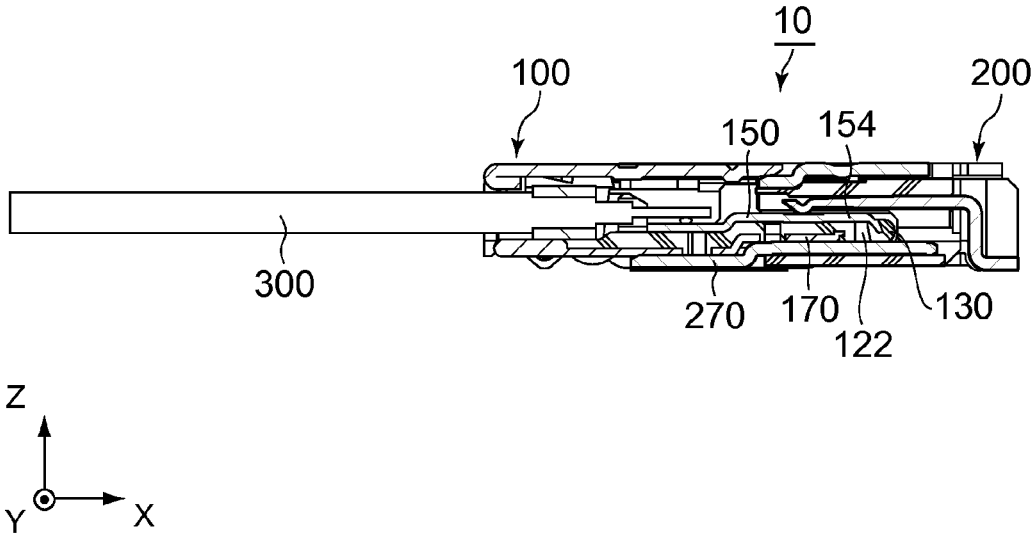
FIG. 2 is a cross-sectional view showing the connector assembly of FIG. 1, taken along lines II-II. An illustration of a cross-section of an electrical cable is simplified and a hatch pattern is omitted (the same shall apply hereinafter).
Figure 3:
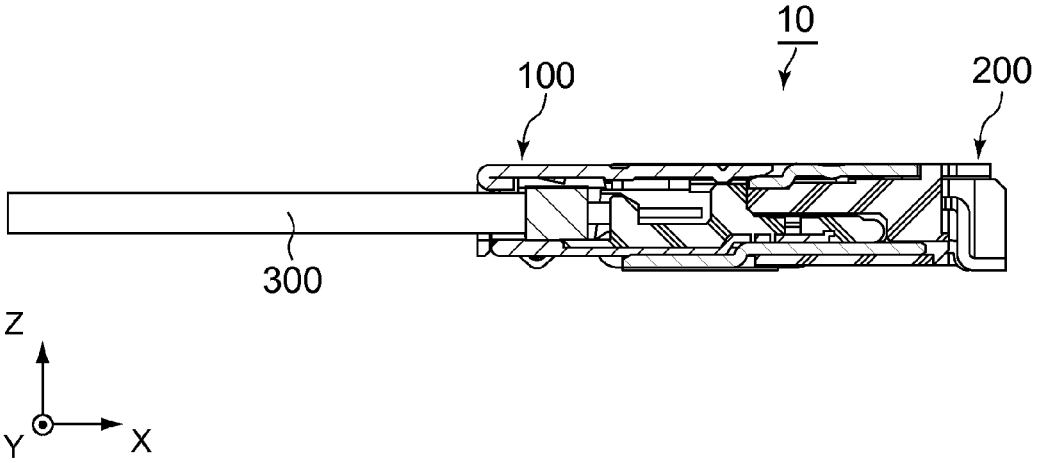
FIG. 3 is a cross-sectional view showing the connector assembly of FIG. 1, taken along lines III-III.

With reference to FIG. 1 to FIG. 3, a connector assembly 10 of an embodiment according to the present invention comprises a connector (a plug connector) 100 and a mating connector (a receptacle connector) 200. A plurality of electrical cables 300 is connected with the connector 100. The mating connector 200 is mounted on a circuit board (not shown). The connector 100 is inserted to and connected with the mating connector 200 along a connection direction and disconnected from the mating connector 200 along a disconnection direction. Herein, with reference to the drawings, the connection direction and the disconnection correspond to a positive X-direction (forward direction) and a negative X-direction (a backward direction), respectively. In the description, a front-back direction corresponds to an X-direction (i.e. both the positive X-direction and the negative X-direction). A pitch direction corresponds to a Y-direction (i.e. both a positive Y-direction and a negative Y-direction). An up-down direction corresponds to a Z-direction (i.e. both a positive Z-direction and a negative Z-direction). An upward direction and a downward direction correspond to the positive Z-direction and the negative Z-direction, respectively.

Figure 4:
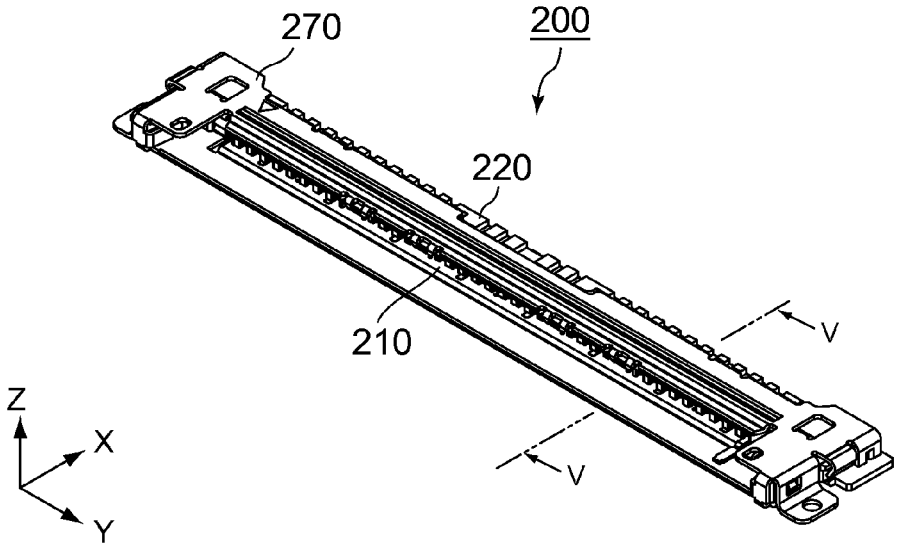
FIG. 4 is an oblique view showing the mating connector of FIG. 1.
Figure 5:
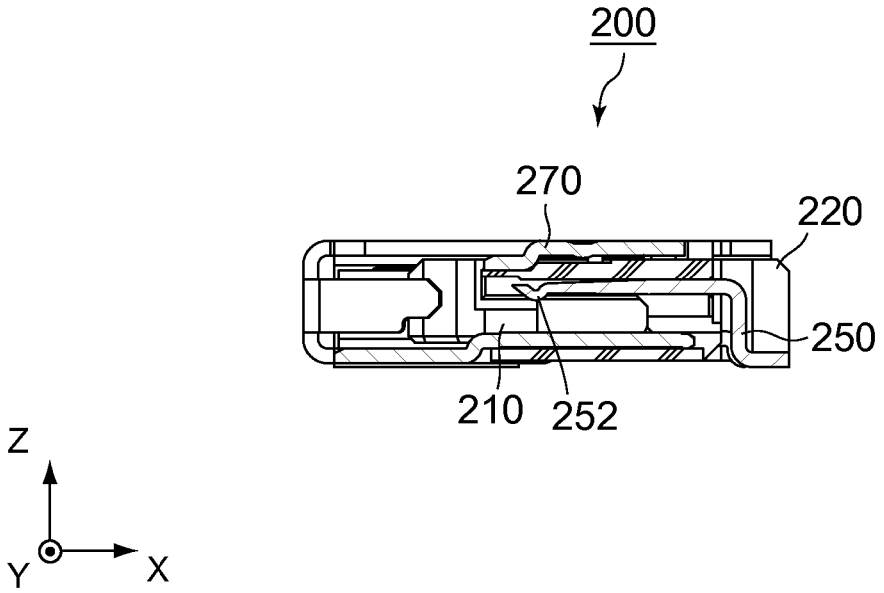
FIG. 5 is a cross-sectional view showing the mating connector of FIG. 4, taken along lines V-V.
Figure 6:
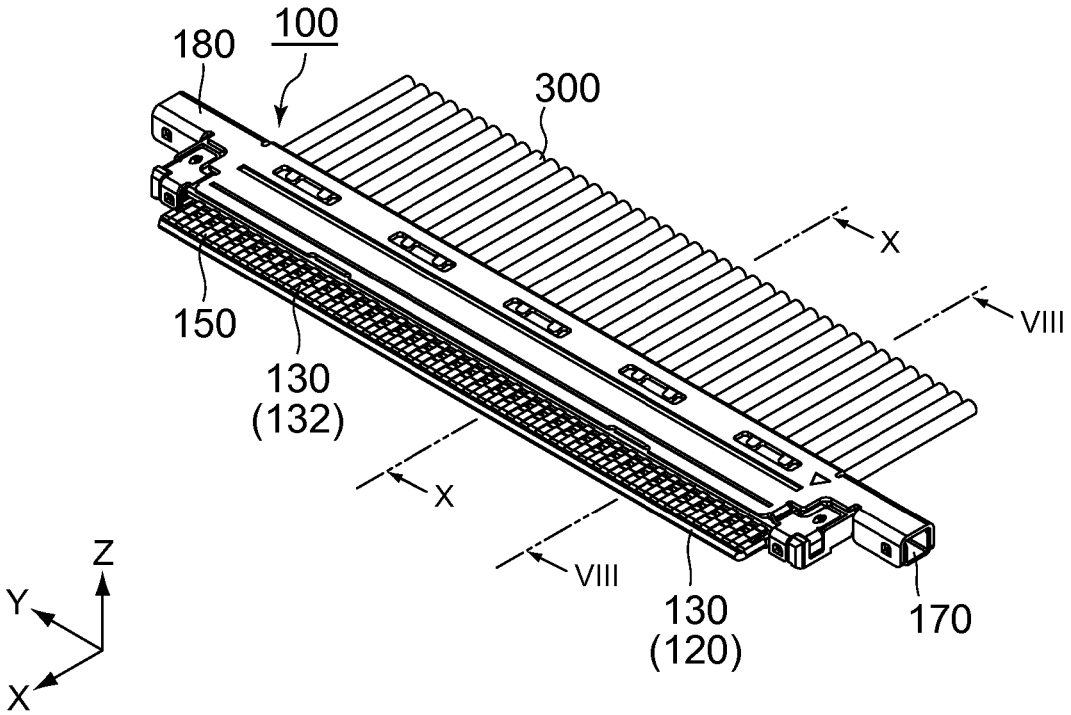
FIG. 6 is an oblique view showing the connector of FIG. 1. A plurality of electrical cables is connected with the connector.

With reference to FIG. 4 and FIG. 5, the mating connector 200 comprises a mating housing 220, a plurality of mating contacts 250 and a mating shell 270. The mating housing 220 is made of an insulative material. The mating contacts 250 and the mating shell 270 are made of metal. The mating connector 200 has a receiving portion 210 which receives a mating portion (explained in detail afterwards) of the connector 100 when the connector 100 is connected with the mating connector 200. The mating contacts 250 are held by the mating housing 220 so that each of contact portions 252 is displaceable in the receiving portion 210.

Figure 14:
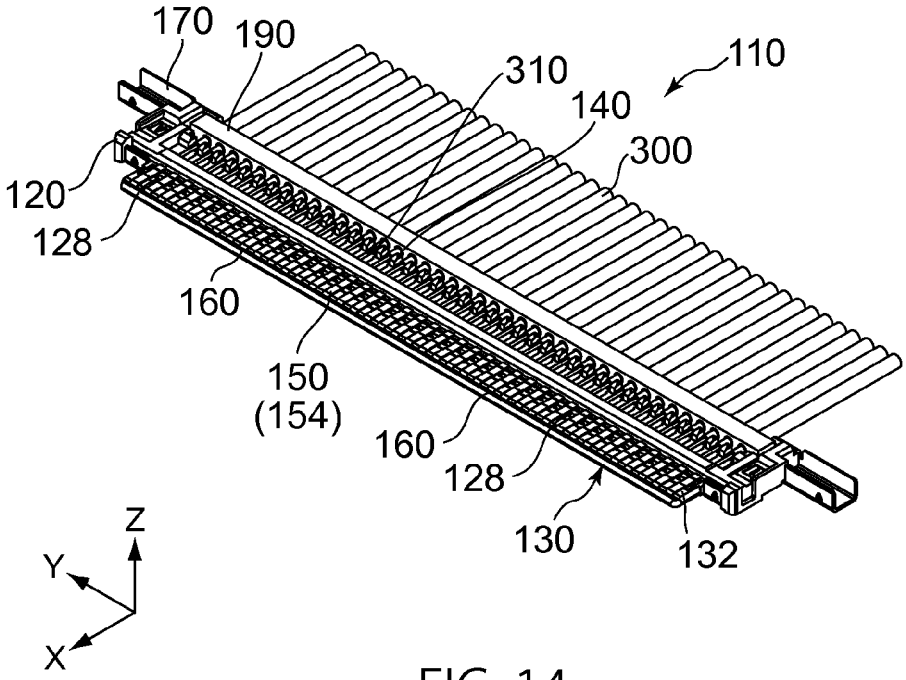
FIG. 14 is an oblique view showing the structure of FIG. 11. A plurality of the electrical cables is connected with the structure.
Figure 15:
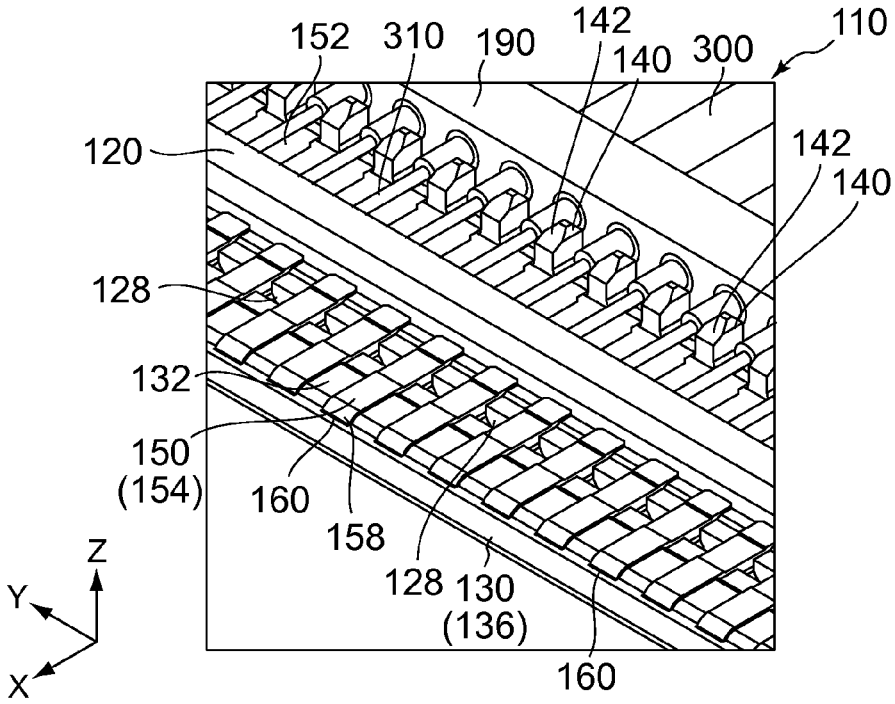
FIG. 15 is a partial, enlarged view showing the structure of FIG. 14.

With reference to FIG. 6 to FIG. 10, the connector 100 of the embodiment comprises a housing 120, a plurality of contacts 150, a mold-in shell (shell) 170 and a cover shell 180. The housing 120 is made of an insulative material. The contacts 150, the mold-in shell 170 and the cover shell 180 are made of metal. In this embodiment, the contacts 150, the mold-in shell 170 and the housing 120 are formed integrally with each other by an insert molding process so as to form a structure 110 shown in FIG. 11 to FIG. 15. The contacts 150 and the mold-in shell 170 are inserted into the housing 120 when the housing 120 is molded. As shown in FIG. 14 and FIG. 15, the electrical cables 300 are connected with the connector 100 as follows. The plurality of the electrical cables 300 is connected with the structure 110, and the cover shell 180 is attached to the structure 110.

Figure 8:
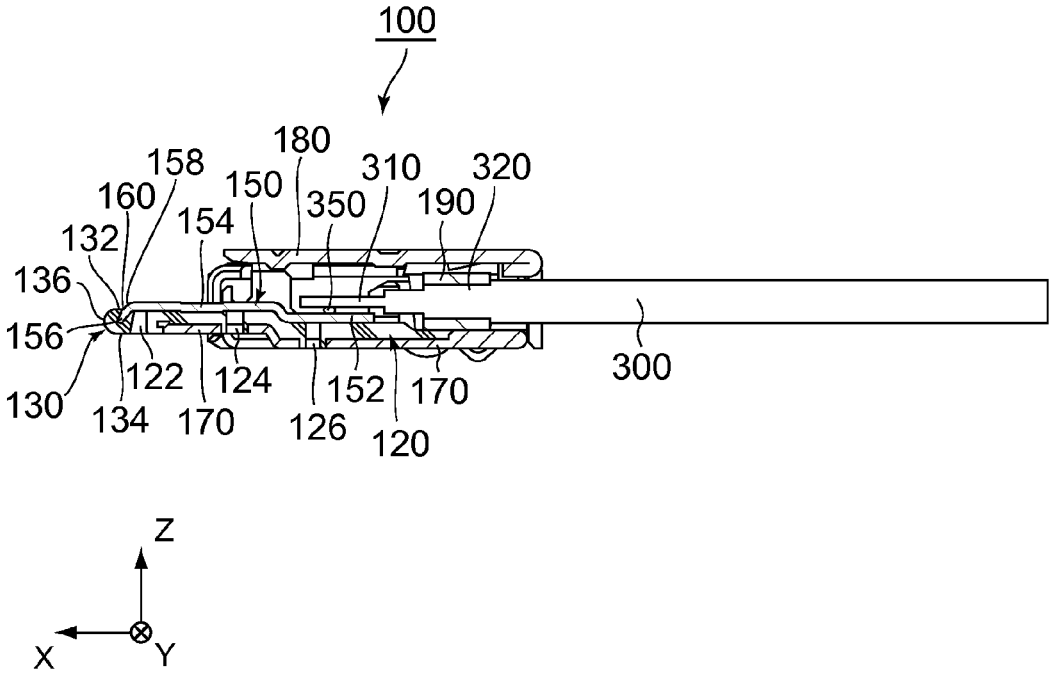
FIG. 8 is a cross-sectional view showing the connector of FIG. 6, taken along lines VIII-VIII.
Figure 9:
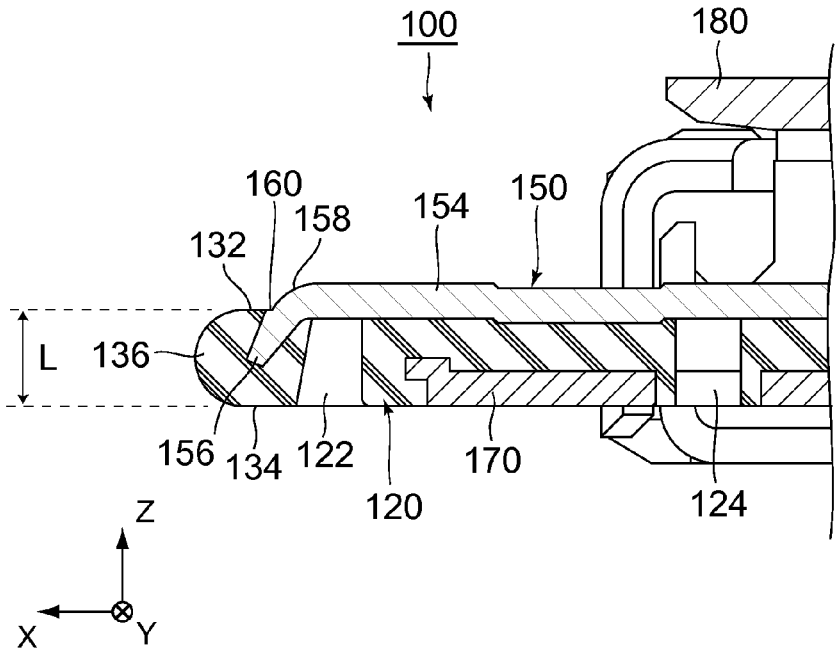
FIG. 9 is a partial, enlarged view showing the connector of FIG. 8.

In detail, as shown in FIG. 8, the contact 150 of the embodiment comprises a connected portion 152, a contact portion 154 and an end portion 156. A core wire 310 of the electrical cable 300 is connected with the connected portion 152 by solder 350. The contact portion 154 is connected with the contact portion 252 of the mating contact 250 when the connector 100 is connected with the mating connector 200. The contact 150 is bent downward so that a bent portion 158 is formed on a front part of the contact portion 154. The end portion 156 is oblique to the front-back direction. A flat portion 160 is formed between the end portion 156 and the bent portion 158. In other words, the flat portion 160 forms a boundary between the contact portion 154 (the bent portion 158) and the end portion 156 as shown in FIG. 9.

As shown in FIG. 6 to FIG. 9, the housing 120 of the embodiment comprises a mating portion 130 having a plate-like shape. A shape of the plate-like portion 130 is long in a pitch direction. The mating portion 130 projects forward and has an upper surface 132 and a bottom surface 134. The upper surface 132 and the bottom surface 134 are in parallel with an imaginary surface (an XY-surface) defined by the front-back direction and the pitch direction. In other words, the upper surface 132 and the bottom surface 134 of the mating portion 130 are perpendicular to the up-down direction. A front end 136 of the mating portion 130 has a half-circular shape in a surface defined by the front-back direction and the up-down direction. This surface is perpendicular to the upper surface 132 and the bottom surface 134 and is in parallel with the front-back direction.

As described above, the contacts 150 are formed integrally with the housing 120 by the insert-molding process. In detail, each of the contacts 150 is held by the housing 120 so that the contact portion 154 extends along the front-back direction and is exposed at the upper surface 132 of the mating portion 130. The end portion 156 of the contact 150 extends obliquely forward and downward so that the end portion 156 is embedded in the mating portion 130 as shown in FIG. 9. The flat portion 160 of the embodiment is flush with the upper surface 132 of the mating portion 130. In other words, the flat portion 160 is in parallel with the upper surface 132 of the mating portion 130. When the housing 120 is molded, a molding-die (not shown) is brought into contact with the flat portion 160 so that no resin would be on the flat portion 160. According to this process, the flat portion 160 is able to be viewed from above the upper surface 132. The flat portion 160 may be positioned lower than the upper surface 132 as long as the molding-die can be brought into contact with the flat portion 160 from above the upper surface 132 when the housing 120 is molded. If the flat portion 160 is positioned upper than the upper surface 132, the mating contact 250 may be scratched by an edge of the flat portion 160 and plating or coating on the mating contact 250 may be come off. Thus, the flat portion 160 is preferred not to be positioned upper than the upper surface 132.

Generally, a contact has a bent portion. Accordingly, it is difficult to fit a molding-die and the bent portion with accuracy. If the contact has no flat portion 160, an undesired clearance may be made between the molding-die and the bent portion, and resin may flow into the clearance. However, the contact 150 of the embodiment comprises the flat portion 160 so that the molding-die can be easily fitted to the flat portion 160. With this structure, the undesired clearance does not exist between the molding-die and the flat portion 160. When the housing 120 is molded, the molding-die blocks a flow of resin and no resin is pushed toward the bent portion 158.

Figure 7:
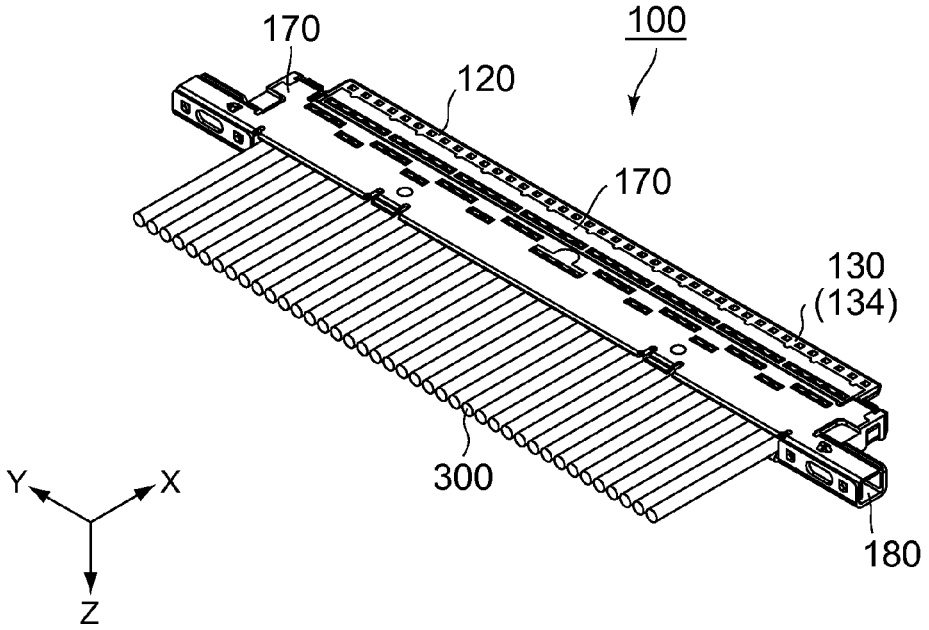
FIG. 7 is an oblique view showing a bottom of the connector of FIG. 6.
Figure 10:
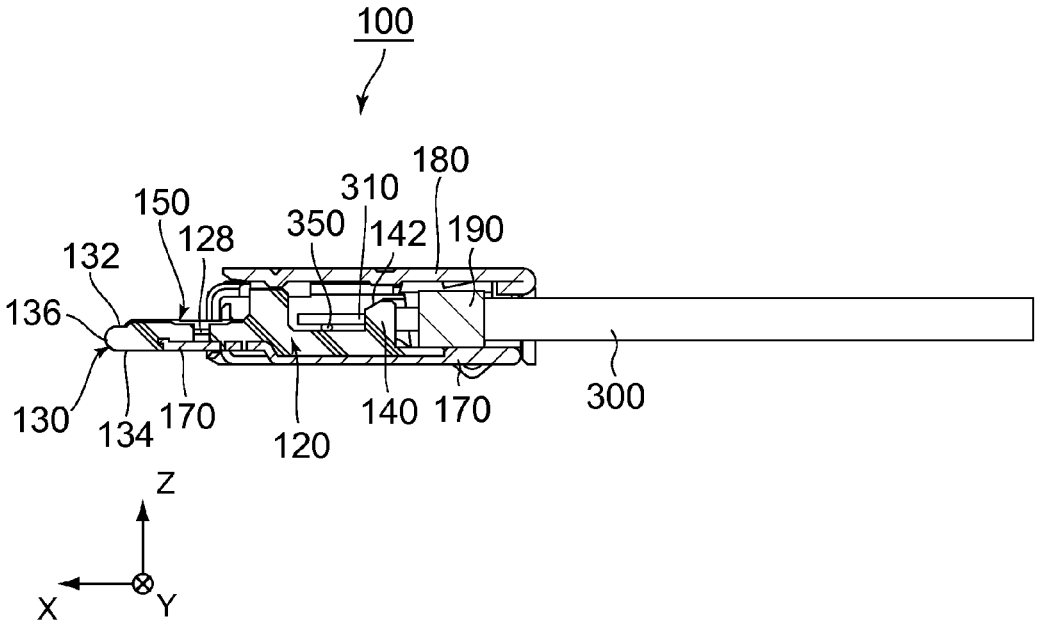
FIG. 10 is a cross-sectional view showing the connector of FIG. 6, taken along lines X-X.
Figure 11:
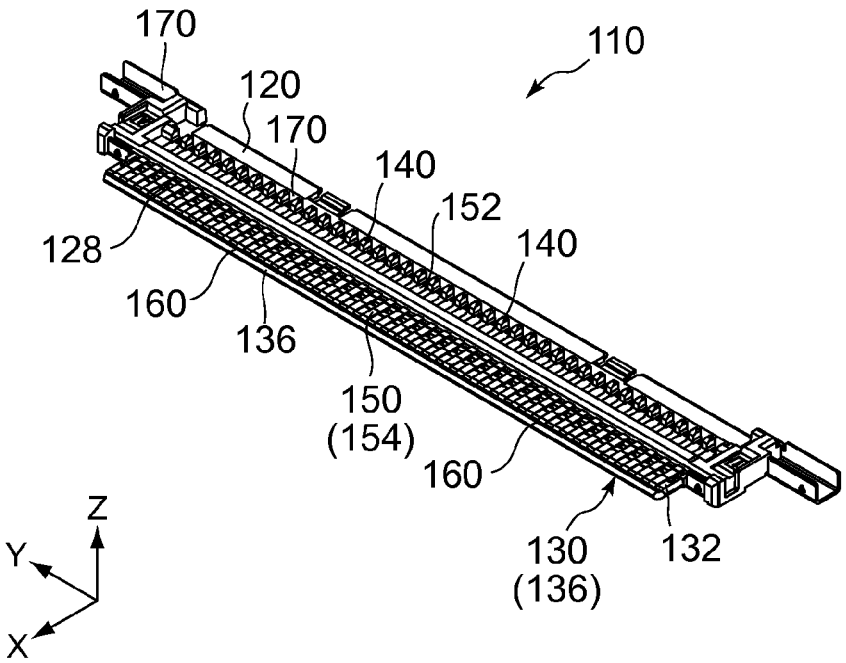
FIG. 11 is an oblique view showing a structure consisting of a housing of the connector, contacts and a shell. The electrical cables are not shown.

As described above, the mold-in shell 170 are also formed integrally with the housing 120 by the insert-molding process. In detail, as shown in FIG. 7, FIG. 8 and FIG. 10, a part of the mold-in shell 170 is exposed at the bottom surface 134 of the mating portion 130. The mold-in shell 170 is electrically connected with the mating shell 270 of the mating connector 200 through the exposed part when the connector 100 is connected with the mating connector 200 as shown in FIG. 2. A connection between the mold-in shell 170 and the mating shell 270 is established under the mating portion 130.

Figure 17:
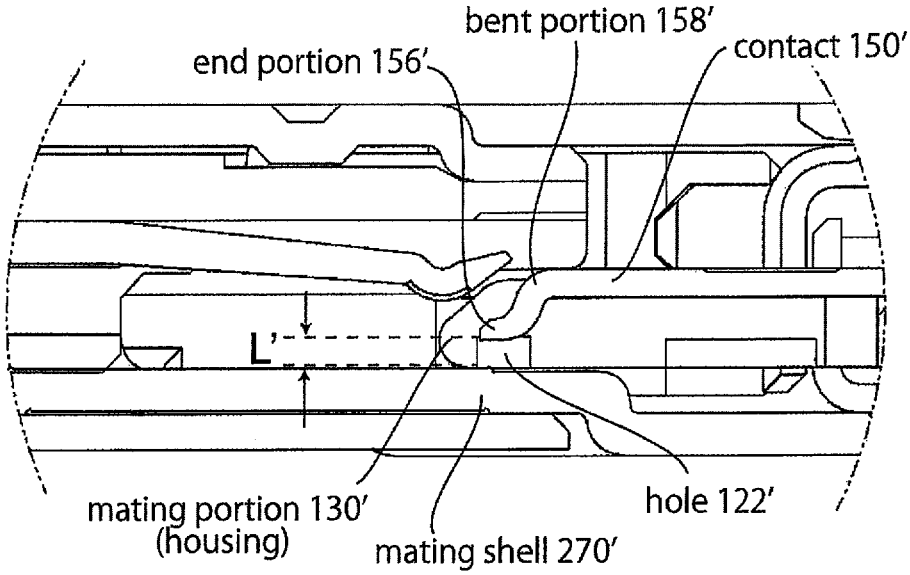
FIG. 17 PRIOR ART
FIG. 17 is a cross-sectional view showing a connector disclosed in JP-A 2010-62072.
Figure 18A:
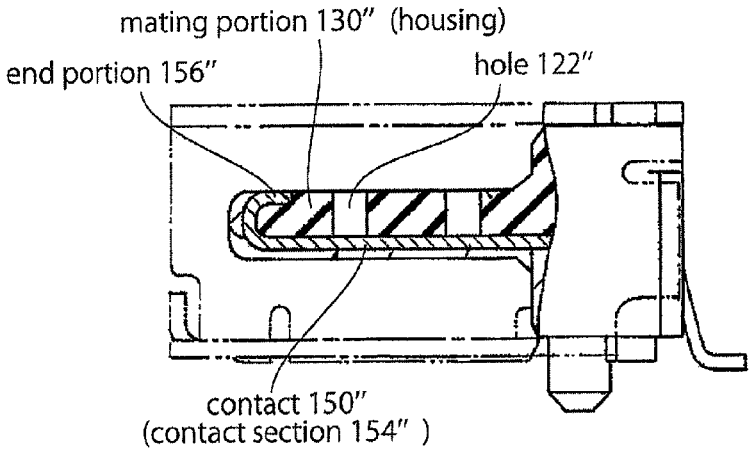
FIG. 18A PRIOR ART
FIG. 18A is a cross-sectional view showing a connector disclosed in JP-A 2004-362827.
Figure 18B:
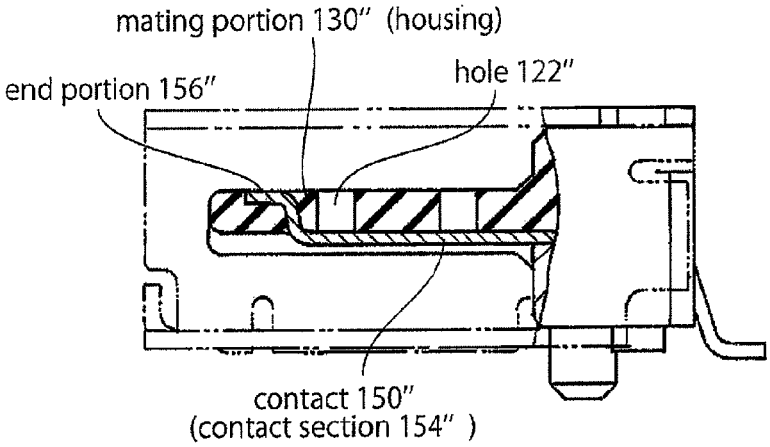
FIG. 18B PRIOR ART
FIG. 18B is another cross-sectional view showing the connectors of FIG. 18A.
Figure 18C:
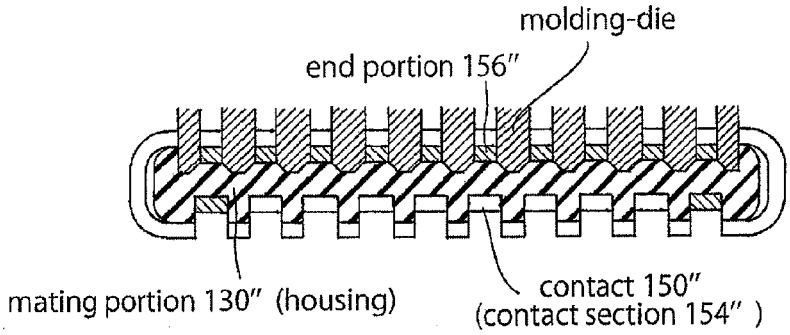
FIG. 18C PRIOR ART
FIG. 18C is a cross-sectional view showing a mating portion of the connectors of FIG. 18A. The illustrated mating portion is viewed from a front of the connector. A molding-die arranges end portions of contacts.

Generally, the molding-die has projecting portions so as to arrange a metal member in an molding object. When the housing 120 is molded, the projecting portions are brought into contact with the contact 150 and the mold-in shell 170 so that the contact 150 and the mold-in shell 170 are arranged on appropriate positions. The projecting portions of the molding-die leave the housing 120 with a plurality of holes 122, 124, 126 and 128 illustrated in FIG. 8 to FIG. 10. In detail, the molding-die is brought into contact with the contact 150 and then the holes 122, 124 and 126 are formed (see FIG. 8). The molding-die is brought into contact with the mold-in shell 170 and then the hole 128 is formed (see FIG. 10). As shown in FIG. 8, among other holes 124, 126 and 128, the hole 122 is positioned closest to the front end 136. The hole 122 is formed on the bottom surface 134 of the mating portion 130 and reaches the contact portion 154. As seen best in FIG. 9, the entire part of the end portion 156 of the contact 150 is embedded in the mating portion 130. In other words, the end portion 156 of the contact 150 is able to be viewed neither from above the upper surface 132 nor under the bottom surface 134. As shown in FIG. 2 and FIG. 9, the contact 150 is positioned on the upper surface 132 of the mating potion 130 while the mating shell 270 is positioned under the bottom surface 134 when the connector 100 is connected with the mating connector 200. In other words, the contact 150 (especially, contact portion 154) is apart from the mating shell 270 by at least a length L which is equivalent to a thickness of the mating portion 130 in the up-down direction (see FIG. 9). In a case where a hole 122' made by the molding-die reaches an end portion 156' of a contact 150' (see FIG. 17), a length L' between the end portion 156' and a mating shell 270' in the up-down direction is smaller than a thickness of a mating portion 130'. Under such condition, an undesired short-circuit may occur between the contact 150' (the end portion 156') and the mating shell 270'. However, according to the connector assembly 10 of the embodiment, the length L between the contact 150 (the contact portion 154) and the mating shell 270 is larger than the length L' between the contact 150' (the end portion 156') and a mating shell 270' so that an occurrence of an undesired short-circuit between the contact 150 and the mating shell 270 can be reduced.

As explained above, the hole 122 and the hole 122' (see FIG. 9 and FIG. 17) are necessarily formed when arranging the contact 150 and the contact 150' (especially for front parts of them) on appropriate positions, respectively. In the present invention, the hole 122 is formed on a position where the length L between the contact 150 and the mating shell 270 is made larger so that the undesired short-circuit is prevented.

Figure 12:
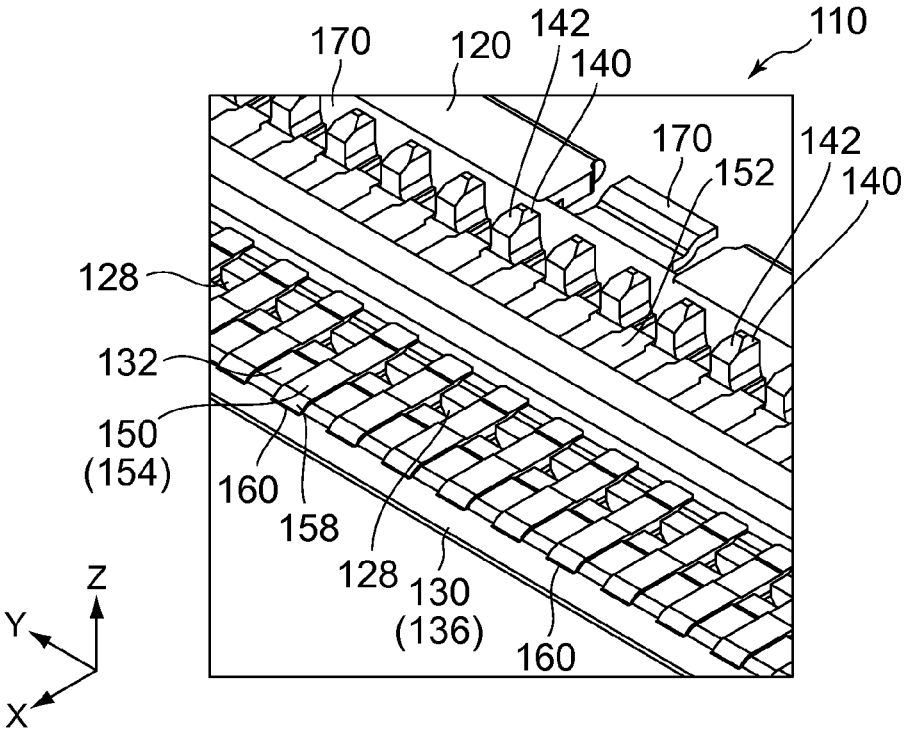
FIG. 12 is a partial, enlarged view showing the structure of FIG. 11.
Figure 13:
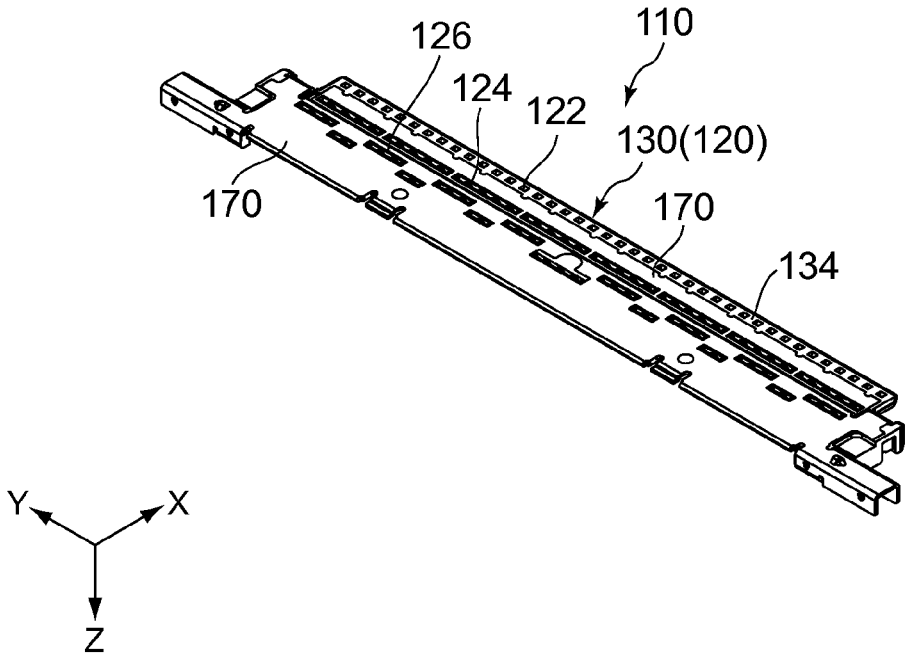
FIG. 13 is an oblique view showing a bottom of the structure of FIG. 11.

As shown in FIG. 11, FIG. 12, FIG. 14 and FIG. 15, the housing 120 of the connector 100 is formed with a plurality of ribs 140 formed at a back of the connected portions 152. The ribs 140 project upward. The electrical cable 300 is arranged between the neighboring ones of ribs 140 so that a core wire 310 of the electrical cable 300 is positioned on the connected portion 152. A clearance between the neighboring ribs 140 may be formed so that the electrical cable 300 is lightly press-fitted into the clearance and is held by the ribs 140. As shown in FIG. 12, each of the ribs 140 is positioned between the neighboring ones of the connected portions 152 in the pitch direction. As shown in FIG. 12 and FIG. 15, the rib 140 has an oblique surface 142 formed on a front part of the rib 140 so that the ribs 140 are kept from contact with a soldering iron (not shown) when the connected portions 152 and the core wires 310 are soldered. The oblique surface 142 is oblique to the XY-surface.

Figure 16:
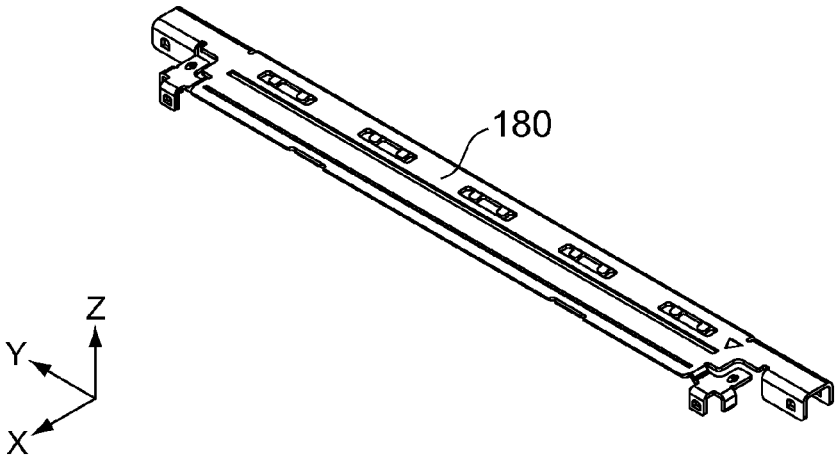
FIG. 16 is an oblique view showing a cover shell of the connector of FIG. 6.

The connector 100 is assembled in the following manner. As shown in FIG. 8, FIG. 10, FIG. 14 and FIG. 15, shield portions 320 of the electrical cables 300 are connected with and held by a ground bar 190 so that the electrical cables 300 and the ground bar 190 are unified into one piece. The core wires 310 is arranged on the connected portion 152 of the contact 150 as described above while the ground bar 190 is arranged on the mold-in shell 170. The ground bar 190 is positioned at a back of the ribs 140 as shown in FIG. 15 and electrically connected with the mold-in shell 170. Each of the connected portions 152 is provided with the solder 350 (see FIG. 8). The core wires 310 are arranged on the solders 350 so that the core wires 310 are electrically connected with the connected portions 152. As described above, the electrical cables 300 are connected with the structure 110 by the above-described process. Subsequently, the cover shell 180 is attached to the structure 110 so that the connected portions 152 and the core wires 310 are covered with and shielded by the cover shell 180 (see FIG. 6, FIG. 14 and FIG. 16).

The present application is based on a Japanese patent application of JP 2011-101549 filed before the Japan Patent Office on Apr. 28, 2011, the contents of which are incorporated herein by reference.

While there has been described what is believed to be the preferred embodiment of the invention, those skilled in the art will recognize that other and further alternative embodiments may be made thereto without departing from the spirit of the invention, and it is intended to claim all such embodiments that fall within the true scope of the invention.

What is claimed is:

1. A connector comprising a housing and a plurality of contacts, the housing including a mating portion having a plate shape, the mating portion projecting forward and having an upper surface and a bottom surface, the plurality of contacts being held by the housing, each of the contacts comprising a contact portion, an end portion, and a flat portion, the contact portion extending in a front-back direction and being exposed at the upper surface of the mating portion, the end portion being embedded in the mating portion, the flat portion forming a boundary between the contact portion and the end portion and not projecting from the upper surface, and the flat portion being viewable from above the upper surface of the mating portion;

wherein:

the connector further comprises a shell formed integrally with the housing by insert-molding;

at least a part of the shell is (i) held by the mating portion, (ii) exposed at the bottom surface of the mating portion and, (iii) connected with a mating shell of a mating connector when the connector is connected with the mating connector;

a hole is formed in the bottom surface of the mating portion, the hole reaching the contact portion; and the end portion of the contact is viewable neither from above the upper surface nor below the bottom surface.

2. The connector according to claim 1, wherein the flat portion is flush with the upper surface of the mating portion.

3. The connector according to claim 1, wherein the flat portion is in parallel with the upper surface of the mating portion.

4. A connector comprising a housing and a plurality of contacts, the housing including a mating portion having a plate shape, the mating portion projecting forward and having an upper surface and a bottom surface, the plurality of contacts being held by the housing, each of the contacts comprising a contact portion, an end portion, and a flat portion, the contact portion extending in a front-back direction and being exposed at the upper surface of the mating portion, the end portion being embedded in the mating portion, the flat portion forming a boundary between the contact portion and the end portion and not projecting from the upper surface, and the flat portion being viewable from above the upper surface of the mating portion;

wherein:

each of the contacts has a connected portion to be connected with a core wire of an electrical cable;

the housing has a plurality of ribs formed at a back of the connected portions in the front-back direction;

the ribs project upward and arrange the core wires on the respective connected portions; and each of the ribs is positioned between neighboring ones of the connected portions in a pitch direction perpendicular to the front-back direction and an up-down direction, each of the ribs having an oblique surface, and the oblique surface being formed on a front part of the rib so as to be oblique to a surface in parallel with the upper surface of the mating portion.

5. The connector according to claim 1, wherein the end portion of the contact extends obliquely forward and downward into the mating portion.

6. The connector according to claim 1, wherein a front end of the mating portion has a half-circular shape in a surface perpendicular to the upper surface and the bottom surface and in parallel with the front-back direction.

7. The connector according to claim 1, wherein:

each of the contacts has a connected portion to be connected with a core wire of an electrical cable;

the housing has a plurality of ribs formed at a back of the connected portions in the front-back direction;

the ribs project upward and arrange the core wires on the respective connected portions; and each of the ribs is positioned between neighboring ones of the connected portions in a pitch direction perpendicular to the front-back direction and an up-down direction, each of the ribs having an oblique surface, and the oblique surface being formed on a front part of the rib so as to be oblique to a surface in parallel with the upper surface of the mating portion.

8. The connector according to claim 1, wherein the contact is formed integrally with the housing by an insert-molding process.

9. The connector according to claim 4, wherein the contact is formed integrally with the housing by an insert-molding process.

10. The connector according to claim 4, wherein the flat portion is flush with the upper surface of the mating portion.

11. The connector according to claim 4, wherein the flat portion is in parallel with the upper surface of the mating portion.

12. The connector according to claim 4, wherein the end portion of the contact extends obliquely forward and downward into the mating portion.

13. The connector according to claim 4, wherein a front end of the mating portion has a half-circular shape in a surface perpendicular to the upper surface and the bottom surface and in parallel with the front-back direction.

* * * * *